US007665733B1

(12) United States Patent
Swanson, Sr.

(10) Patent No.: US 7,665,733 B1
(45) Date of Patent: Feb. 23, 2010

(54) RELIGIOUS GAME

(76) Inventor: Claude R. Swanson, Sr., 8424 20th Ave., Adelphi, MD (US) 20783

( * ) Notice: Subject to any disclaimer, the term of this patent is extended or adjusted under 35 U.S.C. 154(b) by 0 days.

(21) Appl. No.: 12/314,505

(22) Filed: Dec. 11, 2008

(51) Int. Cl.
*A63F 3/00* (2006.01)

(52) U.S. Cl. ..... 273/249; 273/243; 273/430

(58) Field of Classification Search ..... 273/243, 273/249, 430, 431
See application file for complete search history.

(56) References Cited

U.S. PATENT DOCUMENTS

| | | | | |
|---|---|---|---|---|
| 4,121,823 | A | 10/1978 | McBride | |
| 4,201,388 | A | 5/1980 | Cantelon | |
| 4,807,878 | A | 2/1989 | Tripp | |
| 4,934,709 | A | 6/1990 | Peterson | |
| 5,042,816 | A | 8/1991 | Davis et al. | |
| 5,071,133 | A | 12/1991 | Smith | |
| 5,092,606 | A | 3/1992 | Miller | |
| 5,152,535 | A | 10/1992 | Roberts | |
| 5,529,308 | A | 6/1996 | Masakayan | |
| 6,425,582 | B1 * | 7/2002 | Rosi | 273/243 |
| 6,572,110 | B1 * | 6/2003 | Knott | 273/257 |
| 2005/0133996 | A1 * | 6/2005 | Jenkins | 273/243 |
| 2006/0202418 | A1 | 9/2006 | Patterson | |
| 2007/0063434 | A1 | 3/2007 | Keksi | |
| 2008/0007000 | A1 | 1/2008 | Rodela et al. | |

FOREIGN PATENT DOCUMENTS

| | | |
|---|---|---|
| CA | 1004013 | 12/1978 |

OTHER PUBLICATIONS

Website, http://www.truelightchristianstore.com/salvationchallengeboardgame.html, religious board game, one page printed from the internet on Oct. 28, 2008.

* cited by examiner

*Primary Examiner*—Vishu K. Mendiratta
(74) *Attorney, Agent, or Firm*—Richard C. Litman

(57) ABSTRACT

The religious game includes a game board with a playing path thereon, with the path having two phases. A series of question cards with correct responses on their backs is provided for each phase, with each card containing a series of questions, each question corresponding to one of the positions along that phase of the path. A repent area having a series of positions corresponding to the phase one positions is included on the board. The position marker of a player missing a question during phase one play is moved to the corresponding position of the repent area, and cannot return to the playing path until correctly answering a repent question. A missed question in phase two play initially results in a missed turn, with a second consecutive missed question resulting in a severe penalty by setting that player's marker back to an intermediate position in phase one.

4 Claims, 8 Drawing Sheets

10

10

22

22

34

34

46

46

54

RELIGIOUS GAME

BACKGROUND OF THE INVENTION

1. Field of the Invention

The present invention relates generally to board games and the like, and particularly to a religious game that tests or requires knowledge of the players pertaining to religious matters, history, theology, etc.

2. Description of the Related Art

Various games requiring general or specific knowledge of players have been known for a considerable time. Some of the better known games in this field require general knowledge, i.e., trivia, while others require more specialized knowledge in specific fields, e.g., various academic subjects, etc.

A subset of games requiring such specialized knowledge is the religious game, in which knowledge of religion is required to advance or to do well in the game. Generally, such games include an element of chance wherein dice or the like are used to determine the magnitude of each player's advance along the playing path of the board. This results in the possibility of a less knowledgeable player winning the game, if that player is sufficiently fortunate to gain a series of larger advances than other, more knowledgeable players.

Another problem with many such games is that the level of difficulty of the game remains relatively constant throughout. Thus, as players advance toward the end or final goal of the game, the questions involved do not require any greater level of knowledge than the questions received by the players at the beginning of the game. Such a game is certainly not realistic in comparison with most scenarios in life, wherein challenges become more difficult or demanding with greater advance in a given field.

Yet another problem with most such religious games is that they are limited to a specific broad or general religion, e.g., Christianity. Yet, a basic tenet or concept of virtually all religions is tolerance for the beliefs of others. This theme, i.e., broadening the concept of the religious game to include different religions at least in different game versions or variations, is generally not apparent at least in most conventional games having religious themes.

Thus, a religious game solving the aforementioned problems is desired.

SUMMARY OF THE INVENTION

The religious game includes a game board having a single playing path thereon. The path has a sequence of positions advancing from a start position to an end or goal position. The path is divided into two phases, with each phase having a corresponding set of question cards for use therewith. Each card includes a series of questions thereon, with corresponding answers on the back of the card. The questions correspond to the positions along the playing path, and generally increase in difficulty as players advance along the playing path.

The board also has a "Repent" box or area having a plurality of positions therein corresponding to the player positions of the first phase portion of the playing path. A plurality of repent cards, each card containing a question and corresponding answer, is provided for this portion of the game. A player position marker is moved to the corresponding position of the repent box when a player misses a question on a card corresponding to the player position upon which the marker resides.

Different penalties are applied to players who miss one or more questions, depending upon whether the player position marker is on the phase one or phase two portion of the playing path. In phase one, successive incorrect answers result in the player position marker being moved back one position in the repent box for each incorrect answer. When the player answers correctly, the position marker is moved back to the phase 1 portion of the playing path onto the position corresponding to the last position of the marker in the repent box.

The penalties for multiple consecutive incorrect responses in phase two are generally considerably higher than in phase one. In phase two, an initial incorrect answer merely results in the player losing a turn when the position marker is on the phase two portion of the playing path. However, a second successive incorrect answer results in that player's position marker being moved to an intermediate position on the phase one portion of the playing path. At this point, the phase one rules apply to that player. If the player misses another question consecutively, his or her position marker is moved to the position in the repent area corresponding to the previously occupied intermediate position along the phase one portion of the playing path. As the positions of the repent area correspond to the first portion of the playing path, i.e., phase one, this is a serious setback for the player who had previously advanced to phase two. A correct response by the player at this point only returns the position marker to the corresponding phase one playing position, just as if that player had missed a question and been moved to the repent box or area while earlier advancing along the phase one portion of the playing path.

Opportunity for forgiveness of such errors is provided by a plurality of blessing cards randomly placed with the phase one, phase two, and repent cards. A player drawing such a blessing card may retain the card until needed to neutralize the penalty otherwise incurred by an incorrect response.

The object of the game is to respond correctly to questions relating to religion and thereby advance one's position marker progressively along the playing path until reaching the end or goal position. The first player to advance to this end or goal position is the winner of the game. Alternative rules may provide for a shorter or quicker game when desired. For example, other players may be given the opportunity to answer a missed question by one player, thus giving those players a potential chance to advance out of turn to speed up play. Another alternative requires players missing questions on the phase two portion of the path to only miss a turn, regardless of the number of consecutive missed questions. In this manner, players are not sent back to repeat their previous progression along the earlier portion of the playing path.

Authoritative citation for the answers on the backs of the cards may be provided by an appropriate source, e.g., the King James Bible (or other version, as desired) for a game directed to a Christian religious theme, or the Torah for a game having a Jewish theme or the Koran (or Quran) of the Muslim religion for such a game. The game may include the appropriate text or source, depending upon the specific religious denomination used for the game. The board configuration and player position markers may also be themed according to the specific religious denomination or branch to which the game theme is directed. The game may also be developed for electronic or computer play, if so desired.

These and other features of the present invention will become readily apparent upon further review of the following specification and drawings.

BRIEF DESCRIPTION OF THE DRAWINGS

FIGS. 6A, 6B, 6C, 6D, 6E, 6F, 6G, 6H, and 61 are representations of exemplary player position markers for use with the game.

Similar reference characters denote corresponding features consistently throughout the attached drawings.

DETAILED DESCRIPTION OF THE PREFERRED EMBODIMENTS

The present invention relates to a religious game, i.e., a competitive board game or the like having religion as its subject matter. The game tests or requires knowledge of religion of its players in order for those players to be successful at the game. While the present disclosure is directed primarily to a board game, it will be seen that the various aspects of the game may be provided in electronic format for computer play if so desired. A game directed toward a Christian religion serves as the example disclosed in the present embodiment, but it will be seen that the religious game may be constructed for any religion as desired, e.g., Muslim, Judaism, etc. Various aspects of two or more religions may be combined in a single game for the purposes of testing knowledge of comparative religion, if so desired.

Figure 1:
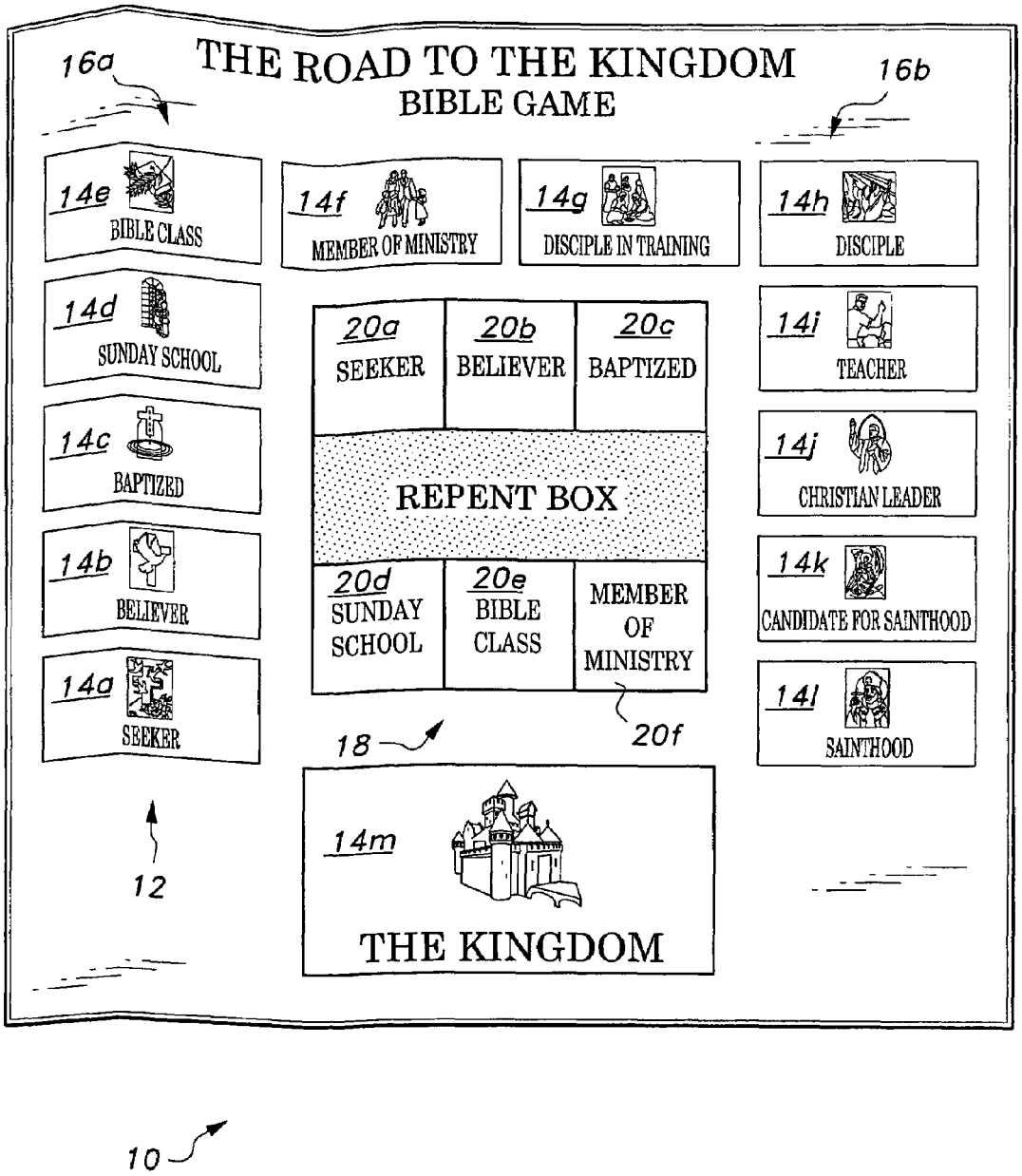
FIG. 1 is a top plan view of an exemplary game board for the religious game according to the present invention.

FIG. 1 of the drawings provides an illustration of an exemplary game board layout 10 for the present game. The game board 10 includes a single playing path 12, peripherally or otherwise disposed on the board. The playing path 12 includes a starting position 14*a* and a separate end or goal position 14*m*, with a series of intermediate positions 14*b* through 14*l* disposed therebetween. Each of the playing positions 14*a* through 14*m* includes a religious theme thereon, with the indicated level of difficulty or expertise increasing at each succeeding level. As an example of the above, the first player position 14*a* of the board 10 of FIG. 1 indicates "Seeker," i.e., one who has not found or is not confident in his or her religious faith. The next position 14*b* is labeled "Believer," i.e., one who believes in a supreme being. This ever-increasing hierarchy continues throughout the series of playing positions 14*a* through 14*l* until reaching the final or goal position 14*m*, indicated as "The Kingdom." It will be seen that different religions may have different indicators for the different levels of difficulty or expertise of each position, and that more or fewer positions may be provided as desired.

The playing path 12 is divided into a phase one or first phase 16*a* comprising the initial six positions 14*a* through 14*f*, and a phase two or second phase 16*b* comprising the final six positions 14*g* through 14*l*. The rules of play differ between the two phases 16*a* and 16*b*, particularly for a player who makes an incorrect response to a question. This process is described in detail further below. The game board 10 further includes a repent area 18, which may be disposed generally centrally on the board 10 or otherwise positioned on the board, as desired. The repent area 18 is further divided into six repent positions 20*a* through 20*f*. These six repent positions correspond exactly to the initial six positions 14*a* through 14*f* of the playing path 12, i.e., the first phase 16*a*. The reason for this configuration is explained in detail further below.

The game is played by players responding in turn to various questions relating to religious subject matter during play. Correct answers permit the player to advance, while incorrect answers result in a setback or at least no advance for a player. The questions are provided on a large number of cards comprising three different series of cards, i.e., first phase, second phase, and repent. Additional cards allowing the holder to avoid a penalty otherwise incurred by an incorrect response, i.e., "Blessing Cards," may also be provided, as explained further below.

Figure 2A:
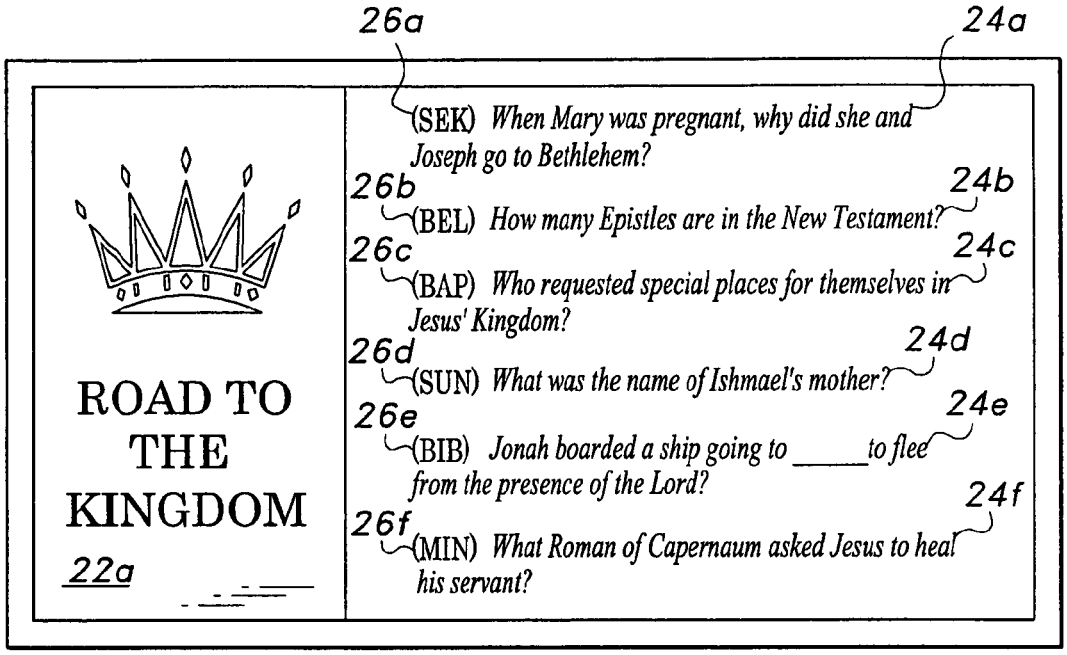
FIG. 2A is a plan view of the first face of an exemplary phase one question card used with the game.
Figure 2B:
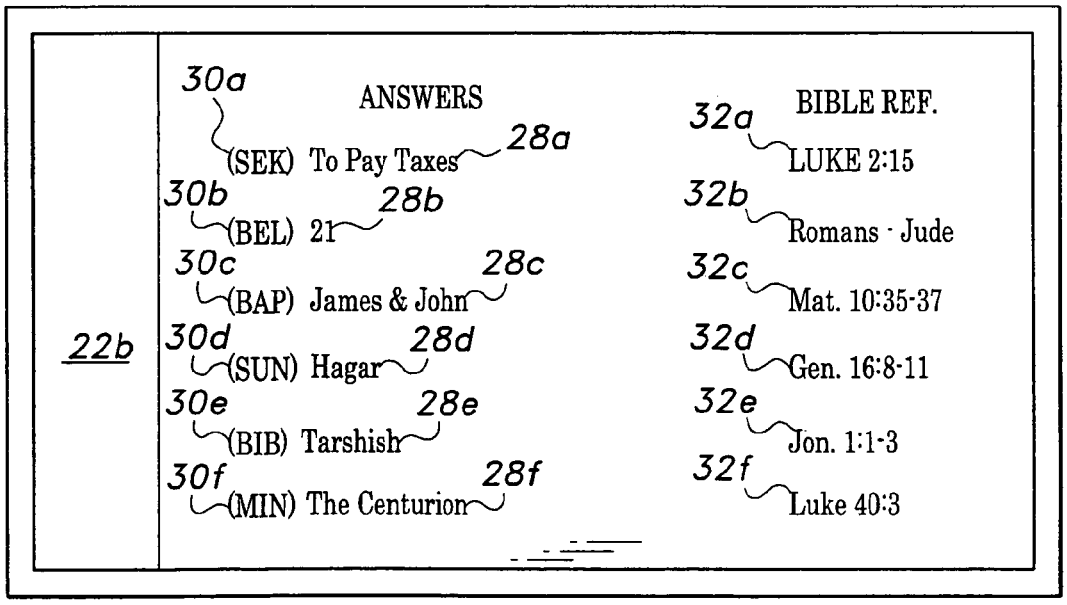
FIG. 2B is a plan view of the opposite face of the phase one card of FIG. 2A.

FIGS. 2A and 2B respectively illustrate the front face 22*a* and the opposite rear face 22*b* of an exemplary first phase card 22. The front or first face 22*a* includes a series of six questions 24*a* through 24*f*, corresponding to the six playing positions 14*a* through 14*f* of the first phase 16*a* of the playing path 12. These questions 24*a* through 24*f* generally increase in difficulty from the first question 24*a* through the last question 24*f*. As each question corresponds to its first phase playing position, a player on a given first phase position is responsible for answering only a single question, i.e., the question corresponding to that position. Each of the questions includes a designator, i.e., designators 26*a* through 26*f*, referencing the corresponding player position to which that question applies.

As an example of the above, assume a player has reached the third or "Baptized" position 14*c* of the playing path 12, as shown in FIG. 1. The corresponding question 24*c* of the card 22 as shown in FIG. 2A reads, "Who requested special places for themselves in Jesus' Kingdom?" This question is further identified by the designator "BAP," corresponding to the third or "Baptized" player position 14*c* on the board 10. Accordingly, the player must attempt to answer this question 24*c*.

Answers are provided on the reverse face 22*b* of the card 22 for verification purposes, as shown in FIG. 2B of the drawings. In the exemplary card 22 of FIGS. 2A and 2B, a series of six answers 28*a* through 28*f* are shown on the back face 22*b* of the card. These answers correspond to the six questions 24*a* through 24*f* on the front of the card, with the answers being further defined by the corresponding designators 30*a* though 30*f*. Thus, the correct answer 28*c* corresponding to the question 24*c*, which corresponds to the third player position 14*c*, is "James and John."

Further verification is provided by references 32*a* through 32*f* to the appropriate book, chapter, and verse of the Bible. In this example, the reference 32*c* is to the book of Matthew, chapter 10, verses 35 through 37, using conventional abbreviated terms to designate the appropriate book, chapter, and verse. The appropriate version of the Bible, e.g., King James, Revised Standard, etc., should be noted in the instructions for the game, and an appropriate edition of the Bible (or other religious reference, e.g., Koran or Quran for a Muslim religious game, Torah for a Jewish religious game, etc.) may be provided optionally with the game as an authoritative source.

Figure 3A:
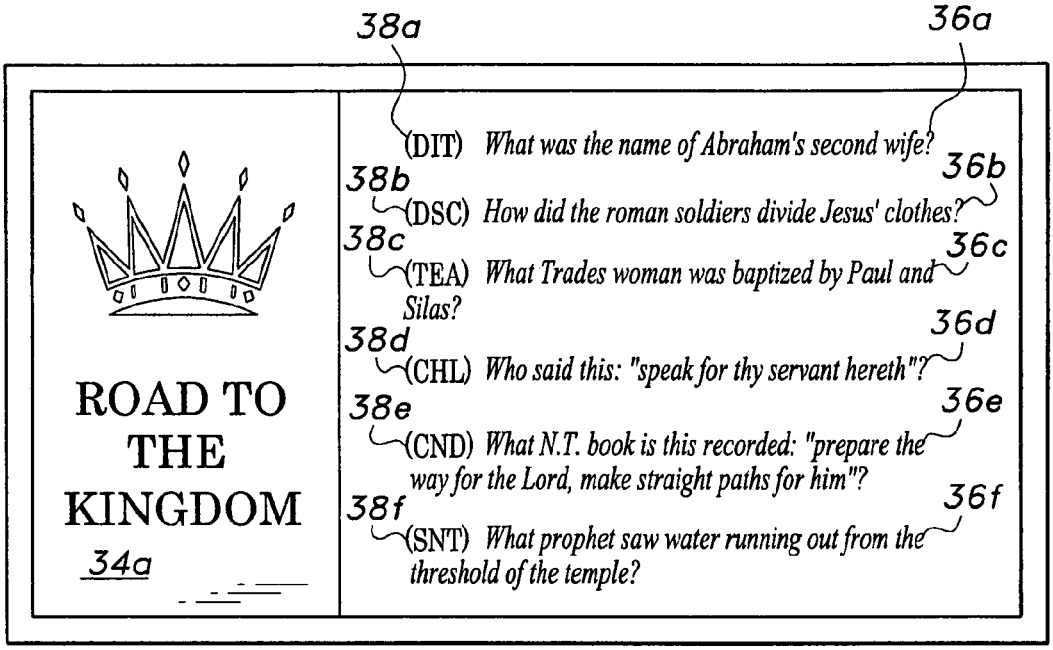
FIG. 3A is a plan view of the first face of an exemplary phase two question card used with the game.
Figure 3B:
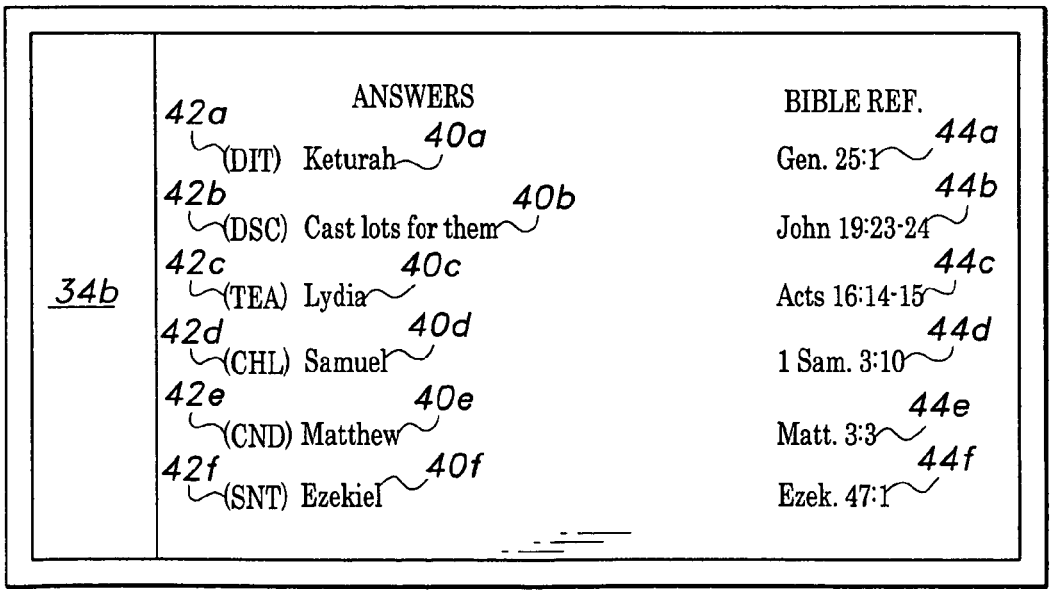
FIG. 3B is a plan view of the opposite face of the phase two card of FIG. 3A.

Much the same procedure is followed for the playing positions 14*g* through 14*l* of the second phase 16*b*. FIGS. 3A and 3B respectively illustrate the front face 34*a* and opposite rear face 34*b* of the second phase card 34. As in the case of the first phase card 22, the second phase card 34 contains a series of six questions 36*a* through 36*f* and their playing position designators 38*a* through 38*f* on its front face 34*a*. As in the case of the first phase card, the questions 36*a* through 36*f* of the second phase card 34 are intended to be increasingly difficult as the player advances along the corresponding second phase positions 14*g* through 14*h*. Corresponding answers 40*a* through 40*f* are provided on the back face 34*b* of the card 34, along with player position designators 42*a* through 42*f* and references 44*a* through 44*f*, as in the case of the first phase card 22.

Figure 4A:
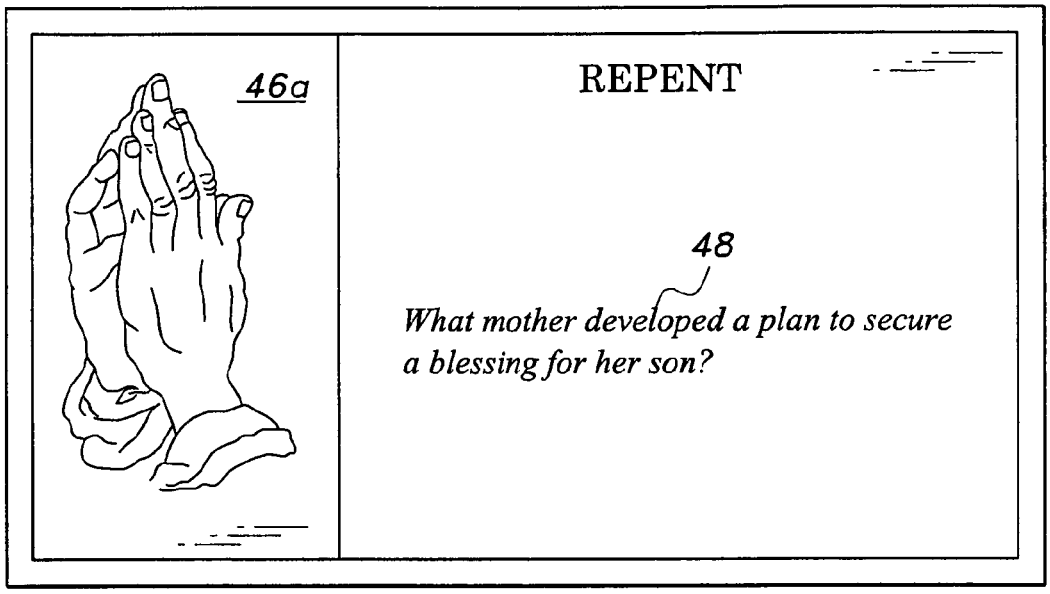
FIG. 4A is a plan view of the first face of an exemplary repent question card used with the game.
Figure 4B:
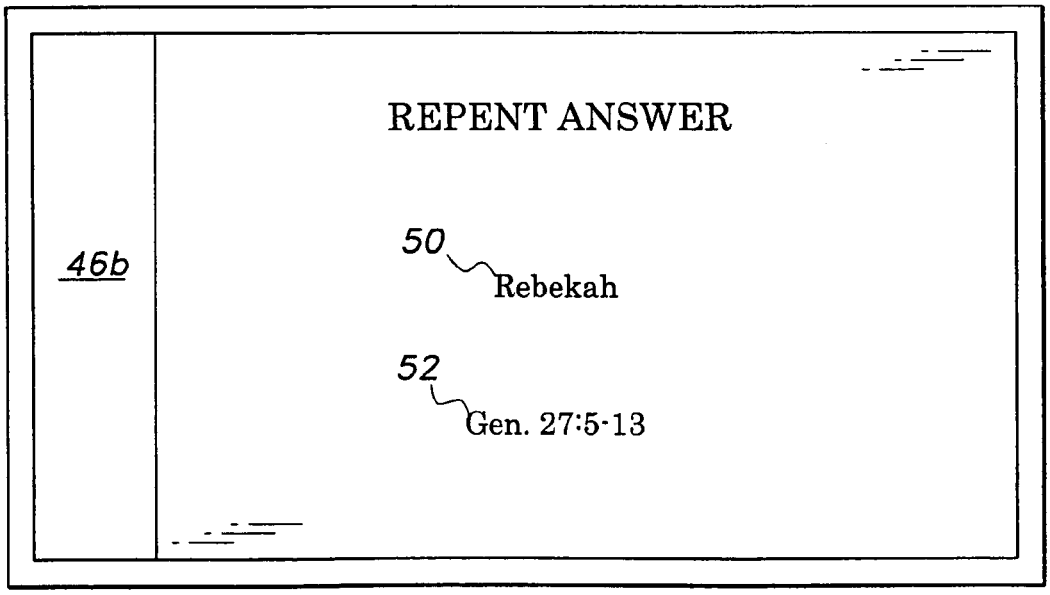
FIG. 4B is a plan view of the opposite face of the repent card of FIG. 4A.

FIGS. 4A and 4B respectively illustrate the front and rear faces 46*a* and 46*b* of a "Repent" card 46. A repent card is drawn randomly by a player who has previously answered a first phase question incorrectly, or has missed a first phase question after moving to the first phase following missed questions while on the second phase portion of the board, and as a result has placed his or her position marker on the appropriate position in the repent box area of the game board layout. The player must correctly answer a repent question in order to advance his or her marker from the repent area back to the playing path of the board. The repent cards 46 are formed similarly to the first and second phase cards 22 and 34, I.e., having a first or front face 46*a* with a question 48 thereon and an opposite second or rear face 46*b* with the correct answer 50 to the question 48. In the case of the repent cards 46 only a single question 48 is provided on the front face 46*a* of each card, rather than including a series of questions of different levels of difficulty thereon. Thus, it is not necessary to include a designator for the level of the question and corresponding playing position, as in the case of the multiple questions of the first and second phase cards. The rear face 46*b* of each repent card also includes a reference 52 for the answer 50, as in the case of the first and second phase cards.

A number of different first phase cards 22, second phase cards 34, and repent cards 46 are preferably provided with the game. Preferably, at least two dozen cards for each phase and for the repent area are provided, with even more such cards, e.g., on the order of fifty, more or less, being further preferred. While a smaller number of cards may be used, the fewer cards available, the easier for players to memorize the correct answers from the cards after several game sessions. The large number of cards, along with the multiple questions and answers on each, result in a multitude of questions to keep the game fresh for players for a considerable time. Moreover, while each first phase and second phase card contains six questions and answers in the present example, it will be seen that this quantity corresponds to the six player positions in each of the two phases 16*a* and 16*b* of the game. If more (or fewer) positions are desired in each of the two phases, a correspondingly greater (or lesser) number of questions (and corresponding answers) are provided on the first and second phase cards, along with a corresponding number of positions in the repent area 18.

Figure 5:
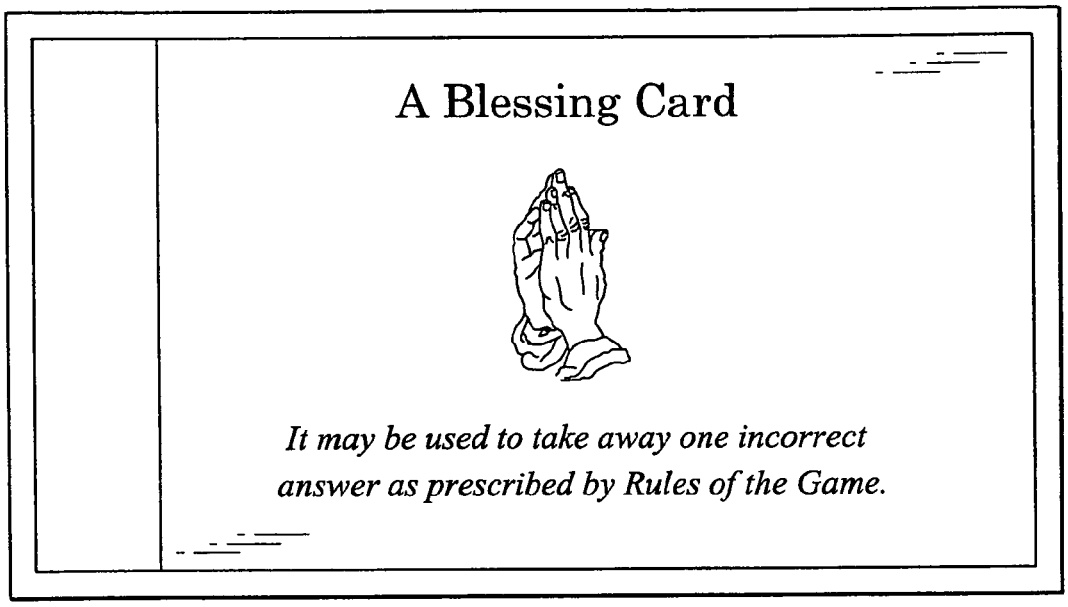
FIG. 5 is a plan view of a blessing card used with the game.
Figure 6A:
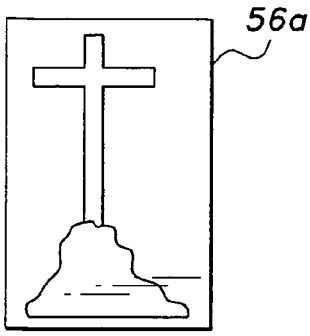
Figure 6B:
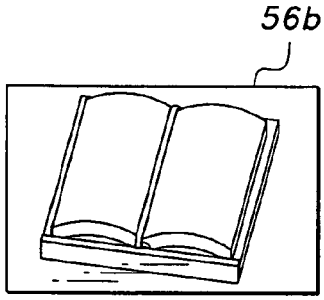
Figure 6C:
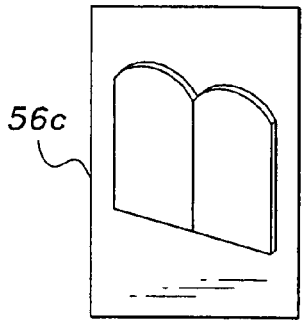
Figure 6D:
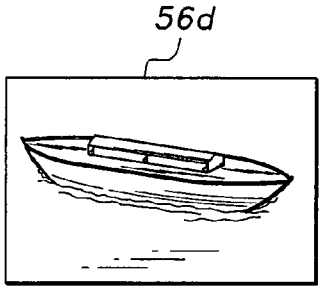
Figure 6E:
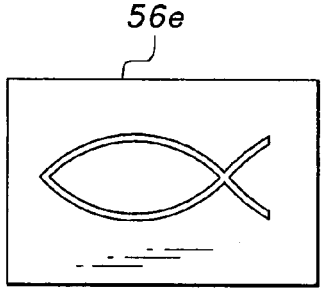
Figure 6F:
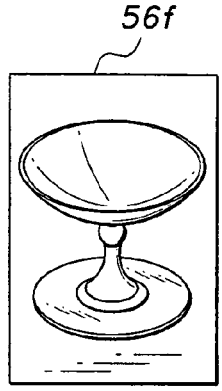
Figure 6G:
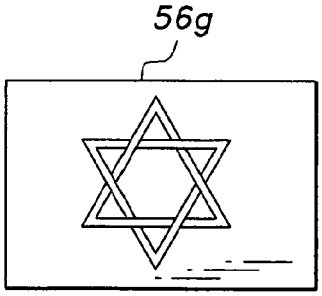
Figure 6H:
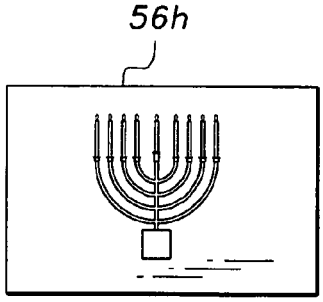
Figure 6I:
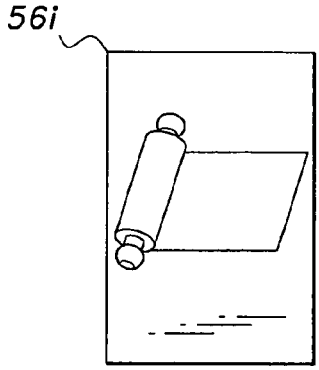

In addition to the above first phase, second phase, and repent cards, a number of "Blessing" cards 54 may be provided with the game. An exemplary blessing card 54 is shown in FIG. 5 of the drawings. Only one face is shown, as the two opposite faces may be identical. Blessing cards 54 are drawn randomly during play and retained by the player drawing the card until needed for future use. Blessing cards 54 are used by players when they answer incorrectly, to cancel the penalty otherwise incurred by answering incorrectly. The position marker of a player using such a blessing card 54 remains on the same position of the playing path as at the start of that player's turn, i.e., it does not advance nor is it moved to the repent area 18 or to any other position on the board.

FIGS. 6A through 6I illustrate a series of exemplary player position markers, respectively 56*a* through 56*i*, for use in designating player positions on the playing path 12 of the game board. While most of the markers represent Christian symbols, e.g., the cross of the marker 56*a* and the fish symbol of the marker 56*e*, others represent other religions, e.g., the star of David marker 56*g*, the menorah marker 56*h*, etc. Others are representative of icons or themes in more than one religion and might be used with games directed to more than one religion, e.g., the tablet position marker 56*c*, the chalice position marker 56*f*, and the scroll marker 56*i*. Other symbols may be used in addition to or in lieu of those shown in FIGS. 6A through 6I, as desired.

Figure 7A:
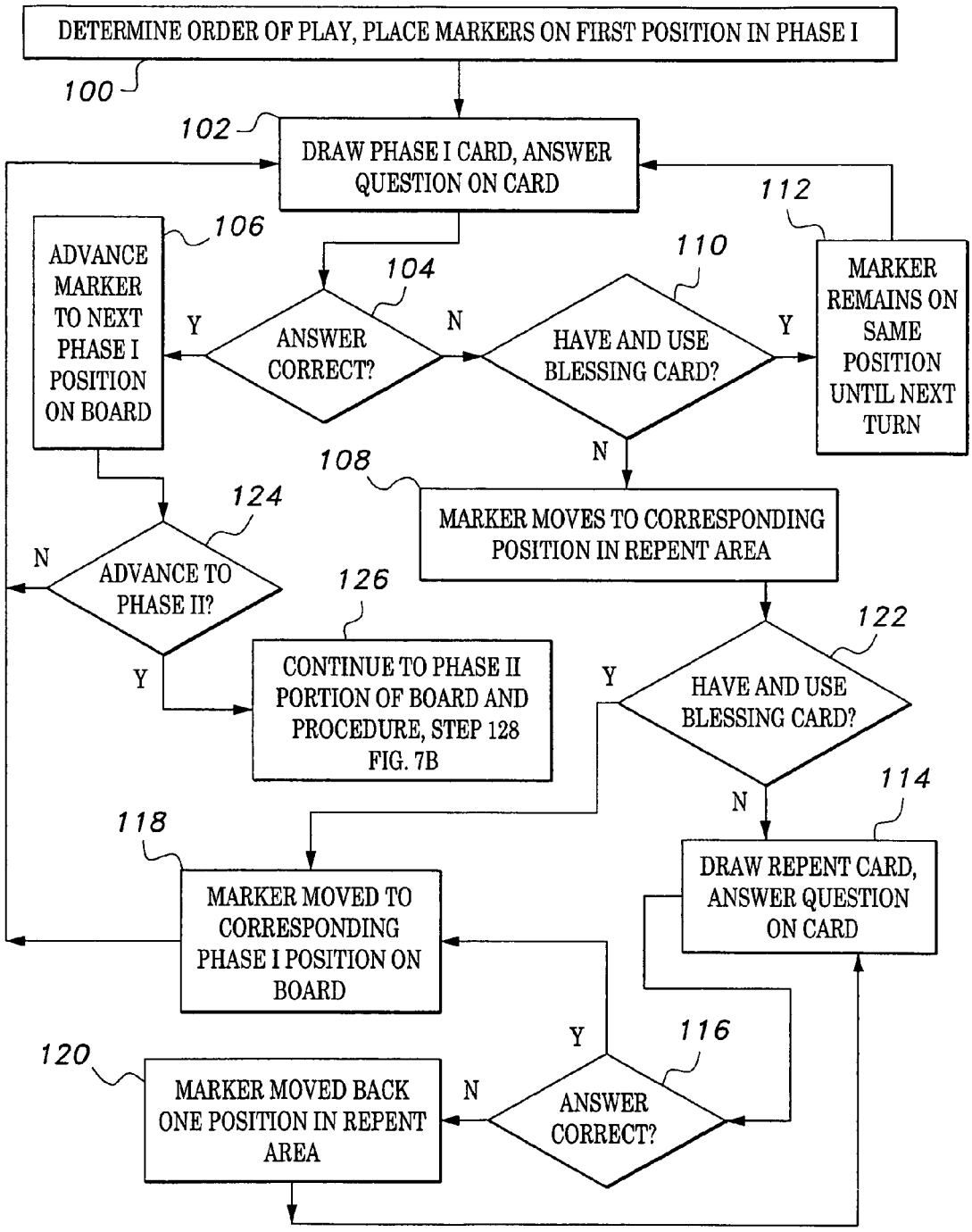
FIGS. 7A and 7B respectively illustrate the phase one and phase two portions of a flowchart showing the steps in the method of play during phase one and phase two of the game.
Figure 7B:
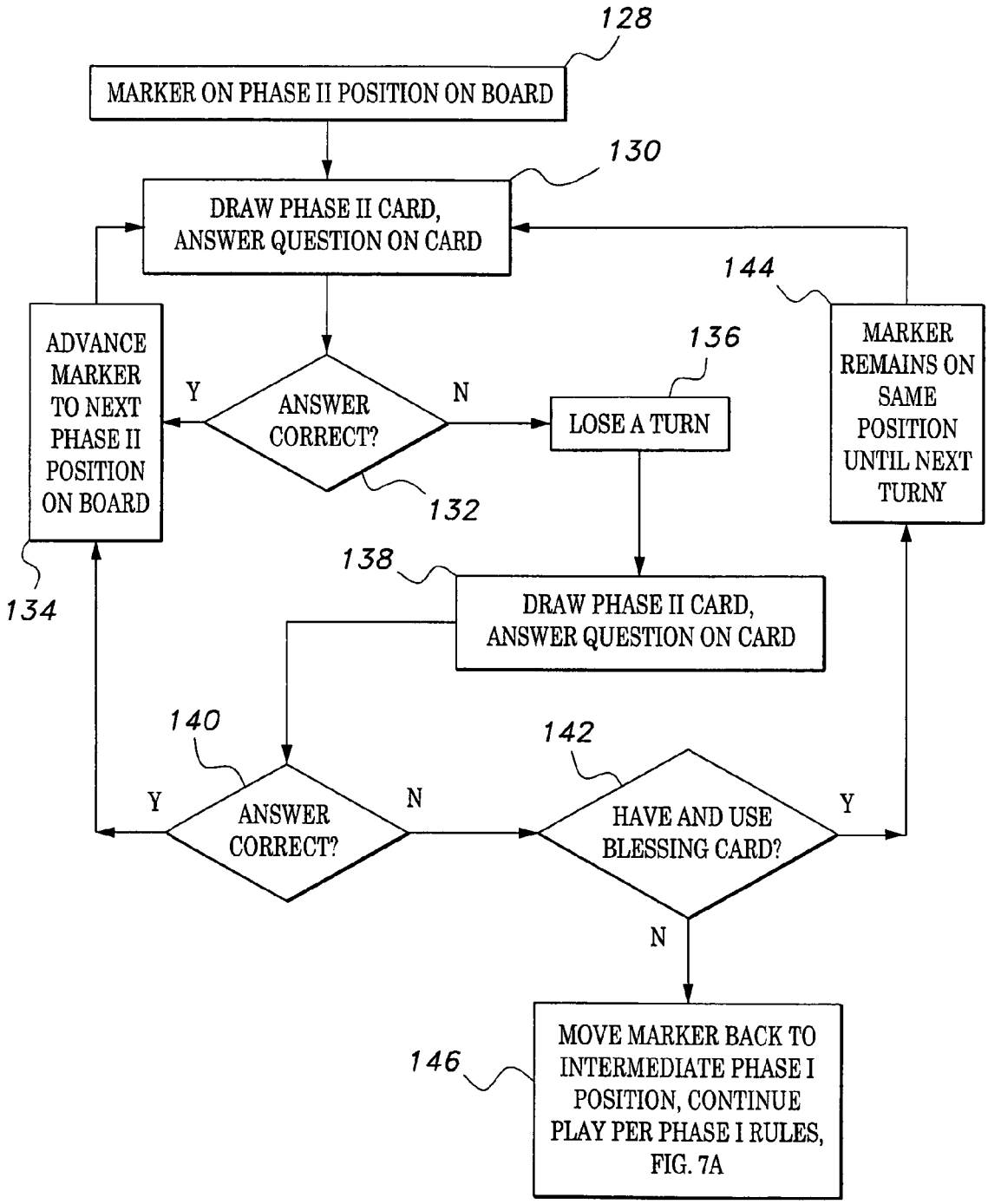

FIGS. 7A and 7B are the two portions of a flow chart illustrating the basic steps in the method of play of the present religious game. FIG. 7A shows the basic steps involved in play over the first portion of the game using the first phase 16*a* of the playing path 12, while the chart of FIG. 7B shows the basic steps involved in the last portion of the game using the second phase 16*b* of the playing path 12 to reach the Kingdom or goal position 14*m*.

Before play is begun, players must determine the order of play and select their position markers, generally as indicated by the first step 100 of FIG. 7A. This may be accomplished conventionally, e.g., using a die, drawing cards or straws, flipping a coin, etc., as desired. A conventional cubical die or other suitable chance device may be included with the game for this purpose.

Once the order of play has been determined and players have selected their position markers, play is begun with the first player drawing a card at random from the first phase cards 22 (example shown in FIGS. 2A and 2B). The first phase cards, as well as other groups or sets of cards, may be placed with their first or question faces facing upwardly or exposed, with the answers on the opposite face thus being concealed. In the event that it is felt that exposure of the question on the topmost card provides an advantage to the acting player, cards may be drawn from the bottom of the stack or deck or concealed prior to drawing to obviate such an advantage.

The acting player, i.e., the player taking his or her turn, reads the question on the first phase card appropriate to the board position of that player's position marker. In the case of a player beginning the game, that player would read the first question on the card, e.g., the first question 24*a* of the first phase card 22, "When Mary was pregnant, why did she and Joseph go to Bethlehem?" This question corresponds to the first or "Seeker" position 14*a* of the game board, as indicated by the "SEK" designator 26*a* adjacent to the question 24*a*. The player then answers the question, as indicated by the second step 102 of FIG. 7A. A time limit is preferably established for a player to answer questions in the game. The time limit, e.g., thirty seconds, or more or less time as the rules may dictate or players may establish, may be determined by a conventional watch, sand glass which might be provided with the game, or a kitchen timer or the like, as desired.

When the player has answered, verification of the answer is provided on the second side 22*b* of the first phase card 22. The correct answer, i.e., "To pay taxes," is shown as the first answer 28*a* on the second side 22*b* of the card. Correlation with the corresponding player position 14*a* and first question 26*a* is provided by the "SEK" designator 30*a* adjacent to the answer 28*a*, with further verification being provided if needed by the Biblical reference 32*a*. The correctly responding player is allowed to advance his or her position marker by one position on the playing path, i.e., from the first position 14*a* to the second or "Believer" position 14*b* in this example, generally as shown by the third and fourth steps 104 and 106 of FIG. 7A.

In the event the player does not answer correctly, that player's position marker is moved to the corresponding position in the repent area or box 18 of the game board 10, generally as shown by the fifth step 108 of FIG. 7A. In the case of a player starting the game on the first or "Seeker" position 14*a*, that player's marker would be transferred to the corresponding first or "Seeker" position 20*a* in the repent box or area 18.

The above is assuming the player has not drawn a "Blessing" card 54 (FIG. 5) to use in avoiding the penalty of the repent area. This would be the case in the first move of the game, where the player has not previously had the opportunity to draw a card. In later plays, the player may randomly draw such a blessing card 54 (example shown in FIG. 5) for use in a situation where he or she does not know the correct answer to a given question. In such later turns, if the player has and uses such a blessing card, that player's position marker remains in place upon the same position as at the beginning of that player's turn before drawing a question card. This is indicated by the sixth and seventh steps 110 and 112 of the flow chart of FIG. 7A.

Much the same procedure is followed by a player whose position marker has been moved to the repent area or box 18. When that player's turn next comes up, the player must draw a "Repent" card 46 (example shown in FIGS. 4A and 4B) and attempt to answer the single question thereon, as indicated by the eighth step 114 of FIG. 7A. Assuming the player answers correctly, that player's marker is moved from the position in the repent area 18 and returned to the equivalent position of the playing path 12, as indicated by the ninth and tenth steps 116 and 118 of the flow chart of FIG. 7A. As an example, if the player's position marker were on the second "Believer" position 20*b* within the repent area 18, the marker would be returned to the second or "Believer" position 14*b* of the first phase portion 16*a* of the playing path, for a correct "Repent" answer by the player.

In the event that the player is unable to answer the "Repent" question correctly, that player's marker is set back one position in the repent area or box, as indicated by the eleventh step 120 in FIG. 7A, assuming the player has not played a "Blessing" card 54 to avoid such a penalty. If the player has and uses a blessing card, as indicated by the twelfth step 122 of FIG. 7A, the procedure is much the same as though he or she had answered a "repent" question correctly and his or her marker is moved to the corresponding position along the first phase 16*a* of the path 12, as indicated by the tenth step 18 of FIG. 7A.

Play continues as described above along the playing positions 14*a* through 14*f* of the first phase 16*a*. However, the penalty rules differ somewhat between the first phase 16*a* and second phase 16*b* portions of the playing path 12. When a player advances to the second phase portion 16*b* of the path 12, as indicated by the thirteenth and fourteenth steps 124 and 126 of FIG. 7A, the player is subject to potentially more severe setbacks in the event of missed questions.

FIG. 7B illustrates the general steps involved in play on the second phase portion of the playing path, beginning with the fifteenth step 128 at the top of FIG. 7B. Once a player's position marker has advanced to the first position 14*g* of the second phase portion of the path on the game board 10, i.e., the "Disciple in Training" position, that player must draw cards from the second phase group of cards, an example of which is shown as card 34 in FIGS. 3A and 3B. The player then attempts to answer the appropriate question on the card, generally as indicated by the sixteenth step 130 (FIG. 7B). If the player answers correctly, the player advances his or her position marker to the next position along the second phase 16*b* of the path 12, generally as indicated by the seventeenth and eighteenth steps 132 and 134 of the procedure as shown in FIG. 7B.

A player along the phase two portion of the path incurs penalties in the event of an incorrect response, as in the case of the phase one portion of the path. However, a single missed question at any one position along the path in the second phase only results the loss of a turn, as indicated by the nineteenth step 136 shown in FIG. 7B.

When the player's turn next comes up after missing one question, the player again randomly draws a phase two question card and answers the question, as indicated by the twentieth step 138 in FIG. 7B. If the player responds correctly his or her position marker is advanced to the next phase two position along the path 12, as indicated by the twenty-first step 140 and its connection to the eighteenth step 134 of FIG. 7B.

In the event that the player misses the question, i.e., the second consecutive incorrect answer, it is greatly advantageous for the player to have and use a blessing card, as indicated by the twenty-second step 142 of FIG. 7B. Assuming the player does have and use a blessing card, his or her position marker is allowed to remain on the same position until the next turn without setback or further penalty, as indicated by the twenty-third step 144 in FIG. 7B. However, if that player does not use a blessing card following two consecutive missed questions during phase two play, his or her marker is moved all the way back to an intermediate position along the first phase 16*a* of the path 12, as indicated by the twenty-fourth step 146 of FIG. 7B. The intermediate phase one position might be the fifth or "Bible Class" position 14*e* (FIG. 1), or other intermediate position according to the rules of play. A player having missed two consecutive questions in phase two play is thus severely penalized, with even greater penalties incurred for players positioned closer to the "Kingdom" goal position 14*m*.

At this point, the player is considered to be at the first phase level of play, and must abide by the rules of play for missing a question along this portion of the playing path. Thus, if the player misses yet another question, his or her marker is removed from the intermediate position along the first phase 16*a* portion of the path (e.g., the "Bible Class" position 14*e*) and moved to the corresponding position within the repent box or area 18 (e.g., the "Bible Class) position 20*e*). At this point, the player must draw a "Repent" card 46 (FIGS. 4A and 4B) and correctly answer the question to return his or her marker to the previous intermediate position along the phase one portion of the path 12. Further consecutive missed questions result in that player's marker being set back further within the repent box area 18, in keeping with the rules described further above for play along the first phase 16*a* portion of the path 12.

Play continues in accordance with the above-described rules and generally as shown on the flow chart of FIGS. 7A and 7B of the drawings, until one player finally advances from the penultimate "Sainthood" position 14*l* to the final goal "Kingdom" position 14*m*, to win the game.

It will be seen that the game will likely require a reasonable amount of time to complete, as it is unlikely that any one player will be able to advance along all of the positions 14*a* through 14*l* of the game board 10 without at least a few incorrect answers and corresponding setbacks. Accordingly, the rules of play may be modified to provide for a faster game, if so desired. One alternative would be to allow subsequent players, i.e., those players following in turn behind the acting player, to attempt to answer any question missed by the acting player. The first subsequent player to answer the question correctly is allowed to advance his or her position marker in accordance with the rules for correctly responding to a question. However, a subsequent player who responds incorrectly would still be subject to the same penalties as the original player.

Another means of accelerating the pace of the game would be to reduce the penalties for incorrect answers. For example, an incorrect answer might result in only a missed turn at that player's next turn, rather than a setback to the repent area or from phase two to an intermediate position in phase one. This rule could be incorporated for either phase one play or phase two play, or for both phases, if so desired. Easier or more basic questions could be provided for younger players, if so desired. The religious game is also well suited for adaptation to electronic or computerized means of play. The game board may be displayed upon a screen, with the text and graphics for question and response cards stored in memory with a random selection process. Player position markers may be displayed on the board and their positions updated automatically, depending upon correct or incorrect inputs by players in response to the questions. In any event, the religious game challenges the religious knowledge of persons playing the game while simultaneously providing an enjoyable and educational pastime.

It is to be understood that the present invention is not limited to the embodiments described above, but encompasses any and all embodiments within the scope of the following claims.

I claim:

1. A method of playing a religious game, comprising the steps of:

(a) placing a playing path comprising a first phase with a starting position and a plurality of first phase playing positions and a second phase having a plurality of second phase playing positions and an end position upon a game board, each of the playing positions having a religious theme;

(b) placing a repent area having a plurality of repent positions each corresponding to one of the first phase positions of the playing path, upon the game board;

(c) providing a plurality of first phase cards each having a first side with a plurality of questions relating to a religious theme thereon, each of the questions corresponding to one of the positions of the first phase of the playing path, and a second side with a plurality of responses thereon and corresponding to the questions of the first side;

(d) providing a plurality of second phase cards each having a first side with a plurality of questions relating to a religious theme thereon, each of the questions corresponding to one of the positions of the second phase of the playing path, and a second side with a plurality of responses thereon and corresponding to the questions of the first side;

(e) providing a plurality of repent cards having a first side with a single repent question thereon, and a second side having a response thereon corresponding to the question of the first side;

(f) providing a plurality of player position markers having a religious theme;

(g) determining an order of play of a plurality of players;

(h) randomly drawing a first phase card and attempting to correctly answer the question thereon relating to one of the first phase playing positions;

(i) advancing the player position marker of the player successfully answering the question of the first phase card, by one position on the playing path;

(j) moving the player position marker of the player incorrectly answering the question of the first phase card to the repent area and the position therein corresponding to the first phase position of the playing path upon which the marker was previously positioned;

(k) randomly drawing a repent card and attempting to correctly answer the question thereon correctly by a player whose marker is in the repent area;

(l) returning the player position marker from the repent area to the first phase position of the playing path where the marker was previously located when the repent card question is answered correctly;

(m) setting the player position marker back one position in the repent area when the repent card question is answered incorrectly;

(n) advancing the player position marker to the second phase playing positions in accordance with correctly answered first phase questions;

(o) advancing the player position marker along the second phase playing positions in accordance with correctly answered second phase questions, by one position along the playing path for each correctly answered question;

(p) losing a turn for a player incorrectly answering a single phase two question;

(q) moving the position marker to an intermediate first phase position of the playing path, for a player incorrectly answering two consecutive phase two questions;

(r) continuing play for missed questions in accordance with first phase rules; and (s) advancing the position marker to the end position in accordance with the above steps in advance of other players to win the game.

2. The method of playing the religious game according to claim 1, further including the steps of:

(a) designating each playing position as an increasingly higher level for each successive position along the playing path; and (b) increasing the level of difficulty of questions corresponding to the increasingly higher level of each successive position.

3. The method of playing the religious game according to claim 1, further including the step of setting a predetermined time limit for players to answer questions.

4. The method of playing the religious game according to claim 1, further including the steps of:

(a) providing a plurality of blessing cards;

(b) randomly drawing one of the blessing cards; and (c) using the blessing card for canceling a penalty for an incorrect answer.

* * * * *